US010704843B2

(12) United States Patent
Guengoer et al.

(10) Patent No.: US 10,704,843 B2
(45) Date of Patent: Jul. 7, 2020

(54) COOLANT CONNECTION OF A HEAT EXCHANGER, CONNECTION STEM, HOUSING SECTION AND INTAKE MANIFOLD

(71) Applicants: MANN+HUMMEL GMBH, Ludwigsburg (DE); Modine Manufacturing Company, Racine, WI (US)

(72) Inventors: Mustafa Guengoer, Backnang (DE); Klaus Gessner, Muehlacker (DE)

(73) Assignee: MANN+HUMMEL GmbH, Ludwigsburg (DE)

( * ) Notice: Subject to any disclaimer, the term of this patent is extended or adjusted under 35 U.S.C. 154(b) by 497 days.

(21) Appl. No.: 15/366,089

(22) Filed: Dec. 1, 2016

(65) Prior Publication Data

US 2017/0160022 A1 Jun. 8, 2017

(30) Foreign Application Priority Data

Dec. 2, 2015 (DE) ..... 10 2015 015 448

(51) Int. Cl.

| | |
|---|---|
| ***F28F 9/02*** | (2006.01) |
| ***F28D 21/00*** | (2006.01) |
| ***F28F 9/00*** | (2006.01) |

(52) U.S. Cl.

CPC ..... *F28F 9/0256* (2013.01); *F28F 9/001* (2013.01); *F28F 9/002* (2013.01); *F28F 9/0248* (2013.01); *F28D 2021/0082* (2013.01); *F28F 2230/00* (2013.01)

(58) Field of Classification Search

CPC ..... F28F 9/0256; F28F 9/002; F28F 9/001; F28F 9/0248; F28F 2230/00; F28D 2021/0082; F16L 21/022

USPC ..... 285/95, 351, 379

See application file for complete search history.

(56) References Cited

U.S. PATENT DOCUMENTS

| | | | | |
|---|---|---|---|---|
| 2003/0234540 | A1* | 12/2003 | Igami | F28F 9/0248 |
| 2004/0035565 | A1* | 2/2004 | Michelfelder | F28F 9/0248 |
| 2006/0108746 | A1 | 5/2006 | Tolle | |
| 2008/0264621 | A1* | 10/2008 | Yoshino | |
| 2014/0299295 | A1 | 10/2014 | Kalbacher | |
| 2014/0300105 | A1 | 10/2014 | Kalbacher | |

FOREIGN PATENT DOCUMENTS

| | | | |
|---|---|---|---|
| DE | 19644337 | A1 | 4/1998 |
| EP | 1288606 | A2 | 3/2003 |
| FR | 2756372 | A1 | 5/1998 |

* cited by examiner

*Primary Examiner* — Zachary T Dragicevich
(74) *Attorney, Agent, or Firm* — James Hasselbeck

(57) ABSTRACT

A coolant connection of a heat exchanger includes at least one male connector on the side of the heat exchanger and at least one connection stem on the side of the housing. The at least one connection stem is designed on its side fluidically away from the heat exchanger for the connection of a coolant line or as part of a coolant line and on its side toward the heat exchanger as a female connector for the at least one male connector. The coolant connection provides at least two circumferential sealing areas. The coolant connector has a connecting flange enclosing radial fluid lines arranged between the sealing areas which vent to the environment. In the event of a seal failure, coolant leakage may pass through the radial fluid lines to the environment, preventing coolant from bypassing the sealing areas into and air intake tract.

8 Claims, 4 Drawing Sheets

COOLANT CONNECTION OF A HEAT EXCHANGER, CONNECTION STEM, HOUSING SECTION AND INTAKE MANIFOLD

TECHNICAL FIELD

The invention relates to a coolant connection of a heat exchanger arranged within a housing comprising at least one male connector on the side of the heat exchanger and at least one connection stem, wherein the at least one connection stem on its side facing away from the heat exchanger for the connection of a coolant line or as a part of a coolant line and on its side facing the heat exchanger is configured as a female connector for the at least one connection stem and, wherein, in the assembled state—in which the at least one male connector at least partially projects into the female connector—at least two sealing areas, each running circumferentially with respect to the connection stem axis are arranged—when axially viewed—one behind the other between a—with respect to a connection stem axis—radially outer circumferential side of the at least one male connector and a radially inner circumferential side of the female connector, wherein at least one—when viewed from the heat exchanger—outer sealing area seals off from a coolant-conducting area and at least one inner sealing area seals off from a fluid conducting area for fluid to be cooled by the heat exchanger.

Furthermore, the invention relates to a connection stem of a coolant connection of a heat exchanger arranged within a housing, wherein the connection stem may be arranged or may have been arranged on the housing side for connection to a male connector on the heat exchanger side, wherein the connection stem on its side fluidically away from the heat exchanger for the connection of a coolant line or as a part of a coolant line and on its side toward the heat exchanger is formed as a female connector for the male connector, and wherein, on a radially inner circumferential side of the female connector, female-side parts of at least two sealing areas, each running circumferentially with respect to the connection stem axis, are arranged one behind the other when viewed axially with respect to the connection stem axis, wherein in the assembled state at least one outer—when viewed from the heat exchanger—sealing area can seal off from a coolant-conducting area and at least one inner sealing area can seal off from a fluid-conducting area for fluid to be cooled by the heat exchanger. Moreover, the invention relates to a housing section of a housing comprising at least one connection stem of a coolant connection of a heat exchanger that can be arranged within the housing, wherein the at least one connection stem may be arranged or may have been arranged on the housing side for connection to a male connector on the heat exchanger side, wherein the at least one connection stem on its side fluidically away from the heat exchanger for the connection of a coolant line or as a part of a coolant line and on its side toward the heat exchanger is formed as a female connector for the male connector, and on a radially inner circumferential side of the female connector, female-side parts of at least two sealing areas, each running circumferentially with respect to the connection stem axis are arranged one behind the other when viewed axially with respect to the connection stem axis, wherein in the assembled state at least one outer—when viewed from the heat exchanger—sealing area can seal against a coolant-conducting area and at least one inner sealing area can seal off from a fluid-conducting area for fluid to be cooled by the heat exchanger.

Beyond that, the invention relates to an intake manifold of an internal combustion engine, for example, a turbocharged internal combustion engine having at least one coolant connection of a heat exchanger arranged in the intake manifold, in particular a charge air cooler having at least one male connector on the heat exchanger side and at least one connection stem on the intake manifold side, wherein the at least one connection stem is formed on its side fluidically away from the heat exchanger for the connection of a coolant line or as a part of a coolant line and on its side toward the heat exchanger is formed as a female connector for the at least one male connector, and wherein in the assembled state—in which the at least one male connector at least partially projects into the female connector—at least two sealing areas each running circumferentially with respect to the connection stem axis are arranged—when viewed axially with respect to the connection stem axis—one behind the other between a—with respect to a connection stem axis—radially outer circumferential side of the at least one male connector and a radially inner circumferential side of the female connector, wherein at least one—when viewed from the heat exchanger—outer sealing area seals against a coolant-conducting area and at least one inner sealing area seals off from a fluid conducting area for charge air to be cooled by the heat exchanger.

BACKGROUND

A nozzle connection for a heat exchanger arranged in a housing is known from DE 10 2013 005 796 A1. The housing may be an intake manifold, wherein an intake nozzle and an outlet nozzle can be used for the supply and removal of charge air or a mixture of charge air and exhaust gas. Two second nozzles are integrated directly or indirectly in the intake manifold. The second nozzles are used for the supply and discharge of a different heat-exchange medium, for example, a fluid that flows through plates or tubes of a heat exchanger stack. The second nozzles are formed toward the outside as connection stems for corresponding lines. The second stems are formed on their opposing other side as a female connector for a male connector. The male connector is arranged on a cover plate of the stack. The male connector has two grooves arranged spaced apart, each of which has a seal that seals against the female connector. The one seal seals toward the fluid side and the other seal toward the charge air side.

SUMMARY

The object of the invention is to design a coolant connection, a connection stem, a housing section and an intake manifold of the type mentioned at the outset in which an operational reliability, in particular as relates to the sealing of the sealing areas, and/or a detection of leaks of the sealing areas can be improved.

This object is achieved according to the present invention in that between at least one outer sealing area and at least one inner sealing area at least one fluid line leads from an inner space of the female connector through a circumferential wall of the connection stem.

According to the invention, at least one fluid line is provided through which, in the case of a leak located in at least one of the adjacent sealing areas, coolant or a fluid to be cooled can accordingly flow out of a space between the radially outer circumferential side of the at least one male connector and the radially inner circumferential side of the at least one female connector. If the at least one unsealed sealing area is an outer sealing area, the coolant from the coolant line can get into the space between the at least one outer sealing area and the at least one inner sealing area. The coolant can be discharged from the inner space of the at least one connection stem through the corresponding at least one fluid line.

A sealing area as described in the invention is an area in which two adjacent fluid-conducting spaces are separated from each other in a fluid-tight manner. A sealing area is realized in particular between at least one male connector and at least one female connected, in particular involving adjacent components. A sealing area can have suitable sealing means, sealing devices or parts thereof, in particular seals, sealing seats and/or sealing surfaces or the like.

With the coolant connection according to the invention, a seal can be enabled that can be simpler and less complicated, in particular compared to known connections, in particular ones standardized according to the VDA (German Automotive Industry Association).

The at least one fluid line can further have the effect that when there is a leak of at least one outer sealing area no coolant get into a region of the heat exchanger or of the housing that conducts the fluid to be cooled, in particular an intake manifold of a turbocharged internal combustion engine. This way, in the case of an intake manifold with heat exchanger when there is a leak of at least one outer sealing area, no escaping coolant can get into the combustion chamber of the internal combustion engine via the intake manifold.

Furthermore, with the coolant connection according to the invention, a position tolerance for the assembly of the housing and/or for the installation of the heat exchanger in the housing can be expanded. In this way, the manufacture and the assembly can be simplified. Via the coolant connection according to the invention, housing sections of the housing, in particular shells of an intake manifold, can be joined to each other, in particular welded, glued or soldered, independently of a position of the at least one male connector and/or of the heat exchanger.

Advantageously, at least one fluid line can be open toward the environment. Thus, in the case of a leak of at least one sealing area, escaping coolant and/or fluid to be cooled can drain into the environment. An appropriate pressure of the coolant and/or fluid to be cooled can be dissipated via at least one fluid line.

Advantageously, at least one opening of at least one fluid line to the environment can be in an area that is visible in particular for maintenance personnel. In this way, the escape of the coolant and/or the cooling fluid can be detected from outside. In this way, a leak of at least one sealing can easily be detected without the coolant connection having to be opened.

Furthermore, using the at least one fluid line, it is possible to prevent coolant from the coolant line from being able to get into the fluid-conducting area of the housing or the heat exchanger for fluid to be cooled or vice versa when there are leaks of the sealing areas between which the fluid line is arranged. In this way, malfunctions and damage in the area of the heat exchanger or a connected load, in particular the internal combustion engine, can be prevented.

Advantageously, at least one male connector and/or at least one female connector can have, at least in sections, a cylindrical and/or conical shape. Advantageously, at least one male connector and/or at least one female connector can have, at least in sections, a round, oval, rectangular or other shape in the cross-section, Advantageously, at least one female connector can have a shape, at least at its radially inner circumferential side, that is essentially complementary to a radially outer circumferential side of the at least one male connector. In this way, the at least one male connector can be arranged to preferably fit in the at least one female connector.

Advantageously, a radially outer circumferential side of at least one male connector can be tapered, in particular stepped and/or conical. At least one fluid line can be located in the area of the taper. At least two sealing areas on opposite sides of the at least one fluid line can be located on opposite sides of the taper. At least one outer sealing area can be located in a cross-sectionally tapered section. At least one outer sealing area can be located in a cross-sectionally expanded section. A diameter of at least one outer sealing area can be smaller than a diameter of at least one inner sealing area. In this way, the insertion of the at least one male connector in the corresponding at least one female connector can be simplified.

Advantageously, at least one connection stem can have at least one connection means for at least one coolant line or be formed at least in sections as a connection means for at least one coolant line. The at least one connection stem can run directly in the area of the connection means, that is axially or bent in relation to a connection stem axis.

Advantageously, at least one male connector in its interior can have at least one fluid channel. The at least one male connector can at least also form in its interior a coolant channel or a coolant line for the coolant. Preferably, the at least one male connector can be hollow in its interior.

Preferably, at least one male connector and at least one corresponding connection stem, in particular a female connector, can be coaxial with respect to the connection stem axis. In this way, they can easily be plugged into each other.

Advantageously, the fluid to be cooled can be gaseous or liquid. In particular, the fluid to be cooled can be or have air, in particular charge air. Advantageously, the coolant can be liquid or gaseous. Liquids can easily be detected when they escape from the at least one fluid line.

Advantageously, the coolant connection according to the invention can be used in conjunction with a charge air cooler of a turbocharged internal combustion engine of a motor vehicle that is arranged in an intake manifold. With the charge air cooler, the charge air charged with a turbocharger can be cooled. Thus, liquid coolant can be used.

However, the invention is not limited to a coolant of this type. Rather, it can also be used with other types of coolant connections of other types of heat exchangers arranged in housings. It may also be used outside of motor vehicle technology, in particular, with industrial engines.

In the case of an advantageous embodiment, at least one connection stem can be connected by multiple parts to at least one housing section of the housing and/or at least one connection stem can be integrally connected to at least one housing section of the housing.

The at least one connection stem can advantageously be connected to an intake manifold shell, which forms the at least one housing section of an intake manifold, which forms the at least one housing of the turbocharged internal combustion engine.

Advantageously, at least one connection stem can be connected by multiple parts to at least one housing section of the housing. The at least one connection stem can thus be manufactured independently of the at least one housing section and be connected thereto in a subsequent assembly phase. In the assembly, the heat exchanger can be arranged within the housing. Thus, at least one male connector can be matched to a corresponding opening of the housing. In particular, the at least one male connector can be inserted through the opening or placed in front of the opening. Then at least one connection stem can be inserted with its female connector fitting onto the male connector. The connection stem can thus project at least partially through the opening of the housing or terminate in front of the opening. The connection stem can be connected to the housing, in particular the housing section permanently, detachably or not non-destructively.

Advantageously, at least one housing, in particular at least one housing section can be modularly designed in multiple parts with at least one connection stem. Therefore, housings or housing sections of different configurations can be combined with connection stems of different configurations as needed.

Advantageously, the diameter of the opening of the housing for the coolant connection may be larger than the outer diameter of the male connector and/or the outer diameter of the at least one connection stem. In this way, the male connector and/or the connection stem can lead through the opening while maintaining a tolerance gap. Therefore, the housing, in particular the housing section of the housing, and the heat exchanger can be assembled with a larger position tolerance. In this way, the production and/or the assembly of the components can be simplified.

Advantageously, the at least one connection stem can have at least one connecting flange. With the at least one connecting flange, the at least one connection stem can be connected to the at least one housing section. At least one connection stem can be connected, in particular integrally, to the at least one connection stem or part of the at least one connection stem.

Advantageously, at least one connection device can be provided with which the at least one connection stem can be joined to the housing section. At least one part of at least one connection device can have at least one connecting flange and/or at least one connection stem or be formed with or by it (them).

At least one connecting flange can overlap at least one opening of the housing section for at least one male connector and/or at least one connection stem. In this way, a stable and/or tight connection can be realized.

Alternatively, or additionally, at least one connection stem can advantageously be integrally joined to at least one housing section of the housing, in particular formed with it. In this way, at least one connection stem, together with the at least one housing section, can in particular be produced in a joint manufacturing process. Furthermore, the at least one connection stem together with the at least one housing section can be connected in a few assembly steps to the male connector and the heat exchanger.

Advantageously, at least one housing section can be connected to at least one connection stem, in particular one made of plastic. The at least one housing section having at least one connection stem may advantageously be manufactured via a molding process, in particular an injection process, casting process, injection-molding process or the like.

In a further advantageous embodiment, at least one connection stem can be connected to at least one housing section of the housing via a form-fitting, and/or non-positive and/or integral connection. In this way, the at least one connection stem can be connected in a robust and/or tight-fitting manner to the at least one housing section.

Advantageously, at least one integral, and/or form-fitting and/or non-positive connection can have at least one bolted joint, in particular via bolts, fitting, a push-in connection, an adhesive joint, a welded joint, a soldered joint, a clamped connection, a snap-on connection, a twist-lock connection, in particular a bolted joint and/or a bayonet joint or the like or a combination of several of the listed or other connection types.

Beyond that, integral connections—in particular adhesive joints, welded joints or soldered joints—can also be realized in a fluid-tight manner. In this way, a separate sealing compound can be waived. Form-fitting and/or non-positive connections, in particular bolted joints, in particular via bolts, push-in connections, bayonet-type connections, clamped connections or the like can be designed as non-destructively detachable.

In the case of a welded joint, soldered joint and/or adhesive joint of the at least one connection stem with the at least one housing section, degrees of freedom in the positioning of the at least one housing section of the housing against another corresponding housing section of the housing, in particular a top shell against a bottom shell of an intake manifold, can be expanded.

Advantageously, a plurality of housing sections of the housing, in particular the top shell and the bottom shell of the intake manifold, can be connected via an integral connection, in particular a welded joint and/or adhesive joint.

In a further advantageous embodiment, at least one connection device of at least one connection stem for the connection with at least one housing section of the housing can be arranged between a fluid-conducting area of the housing for fluid to be cooled and the environment. The at least one outer sealing area and the at least one inner sealing area of the coolant connection can be fluidically arranged between the coolant line and the at least one connection device. The at least one connection device is therefore not directly connected to the coolant line. In this way a risk that coolant can get through the at least one outer sealing area, the at least one inner sealing area and the at least one connection device and into the environment is reduced. If there is a leak in the area of the at least one connection device, just fluid to be cooled can get into the environment. In the case of an intake manifold with an integrated charge air cooler, this would be the charged air. Altogether, the requirement for leaktightness of the at least one connection device can thus be reduced.

In a further advantageous embodiment, at least one sealing device can be arranged between at least one connection stem and at least one housing section of the housing. With the at least one sealing device, a fluid-conducting space of the housing section, in particular for fluid to be cooled, can be sealed off from the environment.

Advantageously, the at least one sealing device can in some cases be arranged in the area of at least one connection device of the at least one connection stem with the at least one housing section. The at least one connection device can thus be sealed off from the environment. Advantageously, at least one sealing device may be combined with at least one connection device, in particular at least integrally formed by it.

Advantageously, at least one sealing device can run circumferentially with respect to the connection stem axis, in particular in a connected manner. In this way, the coolant-conducting space and the space conducting the fluid to be cooled, in particular in the area of the at least one connection device between the connection stem and the at least one housing section can be sealed off from the environment.

Advantageously, the at least one sealing device can have at least one seal, in particular a sealing ring. At least one sealing ring can have an O-ring seal or a flat gasket.

Advantageously, at least one sealing device can have a sealing surface for at least one sealing ring. Due to radial—with respect to the connection stem axis—expansion of the at least one sealing surface that is correspondingly large, a position tolerance can be increased.

Alternatively or in addition, at least one sealing device can be realized via at least one integral connection of the at least one connection stem to the at least one housing section, in particular an adhesive joint, a welded joint and/or soldered joint or the like. An integral connection can easily be realized in a fluid-tight manner. In this way, separate sealing components can be omitted. Due to radial—with respect to the connection stem axis—expansion of the joining regions that is correspondingly large, in particular the bonding region, soldering regions or weld seams, a position tolerance can be expanded.

Advantageously, at least one sealing device between at least one connection stem and at least one housing section can have sealing effect in the direction that is axial with respect to the connection stem axis. In this manner, the at least one sealing device can be arranged in a position-tolerant manner in the radial and/or circumferential direction. In this way, a tolerance compensation in the radial and circumferential direction between the at least one connection stem and the at least one housing section can more easily be realized.

Advantageously, at least one sealing device can be arranged between at least one connection stem and at least one housing section of the housing radially—with respect to the connection stem axis—inside at least one connection device of the at least one connection stem with the at least one housing section. In this way, leaktightness requirements of the connection device can even be reduced.

Alternatively or additionally, at least one sealing device can be arranged radially outside at least one connection device.

Alternatively or additionally, the at least one connection device and the at least one sealing device can be arranged at the same radial height with respect to the connection stem axis. In this way, the at least one connection device can be combined with the at least one sealing device. In particular this can be realized via a fluid-tight, firmly bonded connection.

In another advantageous embodiment, at least one sealing area can have at least one seal that acts at least radially with respect to the connection stem axis between at least one male connector and at least one female connector. Seals with a radially acting sealing effect have the advantage that, when the at least one male connector is inserted in the axial direction with respect to the connection stem axis into the at least one female connector, they can seal with a greater positional tolerance than is the case in particular with purely axially acting seals.

Advantageously, at least one male connector can have at least one seal groove for at least one radially sealing seal on its circumferential side that is outer with respect to the connection stem axis. Alternatively or additionally, at least one female connector can have at least one seal groove for at least one radially sealing seal in its circumferential side that is toward the inside with respect to the connection stem axis.

Advantageously, at least one seal with a radially acting sealing effect can be or have an O-ring seal. O-ring seals can easily be installed in particular in a seal groove. O-ring seals can easily slide against a sealing surface opposite the seal groove when the at least one male connector is inserted into the at least one female connector.

In another advantageous embodiment, at least one male connector and at least one connection stem can be made of different materials that are not—or only with difficultly or unreliably—integrally joinable. In this way, the at least one male connector and at least one connection stem can each be configured in a way that is optimal for each with regard to their respective function. With the coolant connection according to the invention, a reliable connection between the at least one male connector and the at least one connection stem can nevertheless be realized.

Advantageously, the at least one insertion piece can at least have metal or be made of metal.

Advantageously, the at least one insertion piece can be made of the same or a similar material as a region of the heat exchanger, in particular a cover plate to which the at least one insertion piece is connected. In this way a connection of the at least one insertion piece to the heat exchanger can be more easily and/or more reliably realized.

Advantageously, at least one male connector can be connected integrally or by multiple pieces to the heat exchanger, in particular a cover plate.

Advantageously, at least one male connector can be connected integrally and/or in a form-fitting and/or non-positive way to the at least one heat exchanger, in particular the cover plate. In particular, at least one insertion piece can be soldered or welded to the heat exchanger.

Advantageously, at least one connection stem can at least have plastic or be made of plastic. In this way, it can easily be produced.

Advantageously, at least one connection stem can be made of the same or a similar material such as at least one housing section of the housing to which the at least one connection stem is connected or is to be connected. In this way, the at least one connection stem can easily be connected integrally or by multiple pieces to the housing section.

Furthermore, the object is achieved according to the invention in the case of the connection stem in that at least one fluid line leads from an inner space of the female connector through a circumferential wall of the connection stem between at least one part of at least one outer sealing area and at least one part of at least one inner sealing area.

At least one part of a sealing area on the side of the connection stem can have at least one sealing surface, one seal seat and or one seal or the like or be formed from them.

Moreover, the object is achieved according to the invention for the housing section by at least one fluid line leading out from an inner space of the female connector through a circumferential wall of the connection stem between at least one part of at least one outer sealing area and at least one part of at least one inner sealing area.

Beyond that, the object is achieved according to the invention for the intake manifold by at least one fluid line leading out from an inner space of the female connector through a circumferential wall of the connection stem between at least one outer sealing area and at least one inner sealing area.

Moreover, the features and advantages demonstrated in connection with the coolant connection according to the invention, the connection stem according to the invention, the housing section according to the invention, and the intake manifold according to the invention and the respective advantageous embodiments thereof are mutually applicable, mutatis mutandis. It shall be readily understood that the individual features and advantages can be combined with one another, wherein other advantageous effects that go beyond the sum of the individual effects may emerge.

BRIEF DESCRIPTION OF THE DRAWINGS

Other advantages, features, and details of the invention shall be made more apparent by the following description, which addresses embodiments of the invention in greater detail, with reference to the accompanying drawings. The features disclosed in the drawings, the description, and the claims in combination will be individually considered, as appropriate, and combined into other appropriate combinations by a person skilled in the art. In the schematic drawings.

Figure 1:
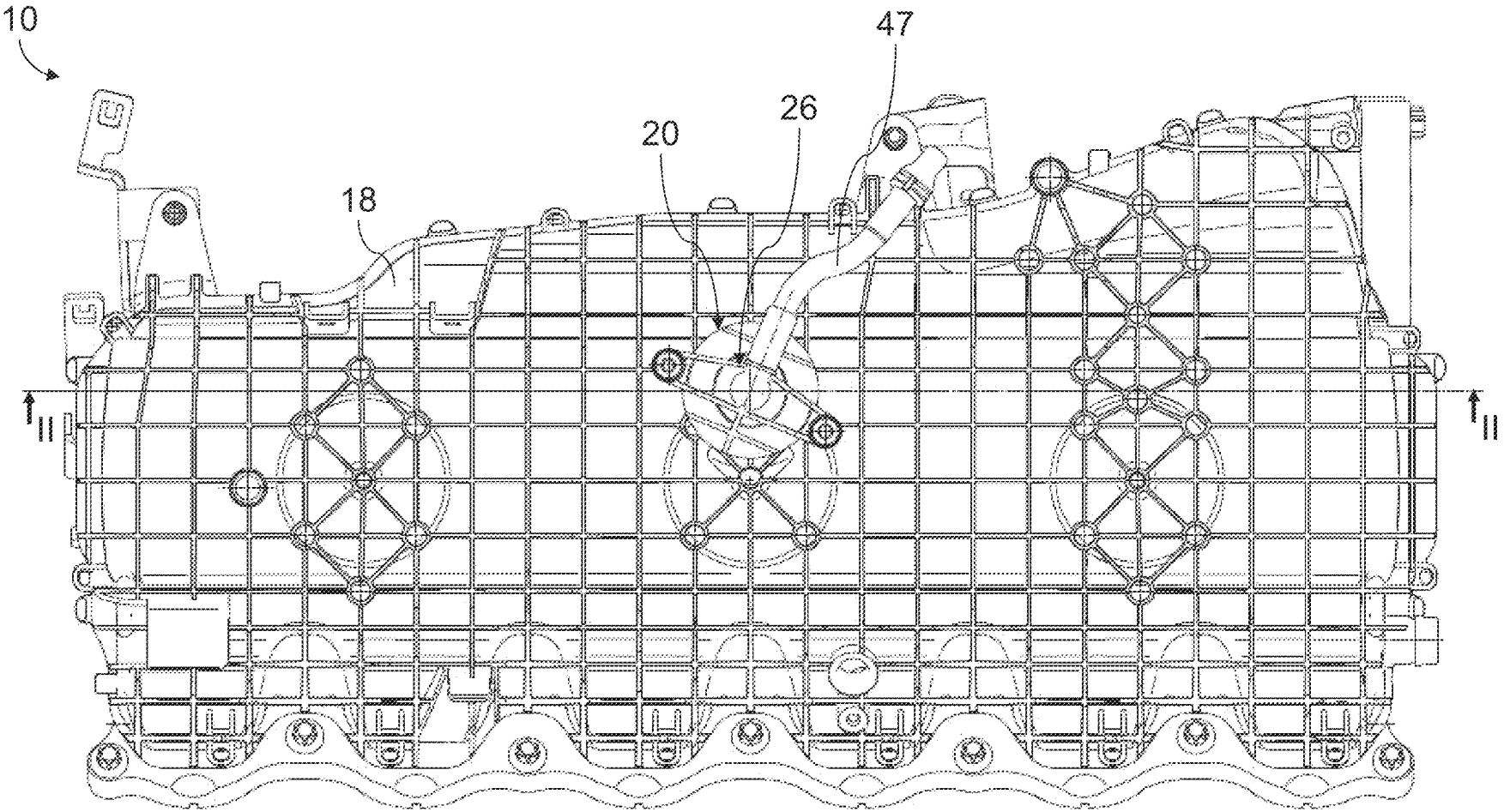
FIG. 1 is a plan view of an intake manifold with an integrable charge air cooler of a turbocharged internal combustion engine of a motor vehicle having a coolant connection according to a first embodiment.

In the drawings, like components are assigned like reference signs.

DETAILED DESCRIPTION

Shown in FIGS. 1 to 4 is an intake manifold 10 having an integrated charge air cooler 12 of a turbocharged internal combustion engine (not otherwise depicted) in different views and sections. The intake manifold 10 is arranged between a compressor of a turbocharger and the combustion chambers of the internal combustion engine and connects them to each other. With the intake manifold 10, charge air that is sucked in from the environment, filtered with a filter—not of further interest here—and compressed with the compressor is conducted from the compressor to the combustion chambers. The charge air cooler 12 is used to cool the charge air in a known way. For the heat exchange, a suitable coolant is conducted through the charge air cooler 12. The charge air cooler 12 may be, for example, a so-called plate cooler.

The intake manifold comprises a housing 14 that is made up of a bottom shell 16 in FIG. 2 below and a top shell 18. The bottom shell 16 and the top shell 18 are each molded out of plastic as separate components. The charge air cooler 12 is arranged in the inner space 72 of the housing 14 in such a way—not of further interest here—that charge air can flow into it and through it.

Figure 2:
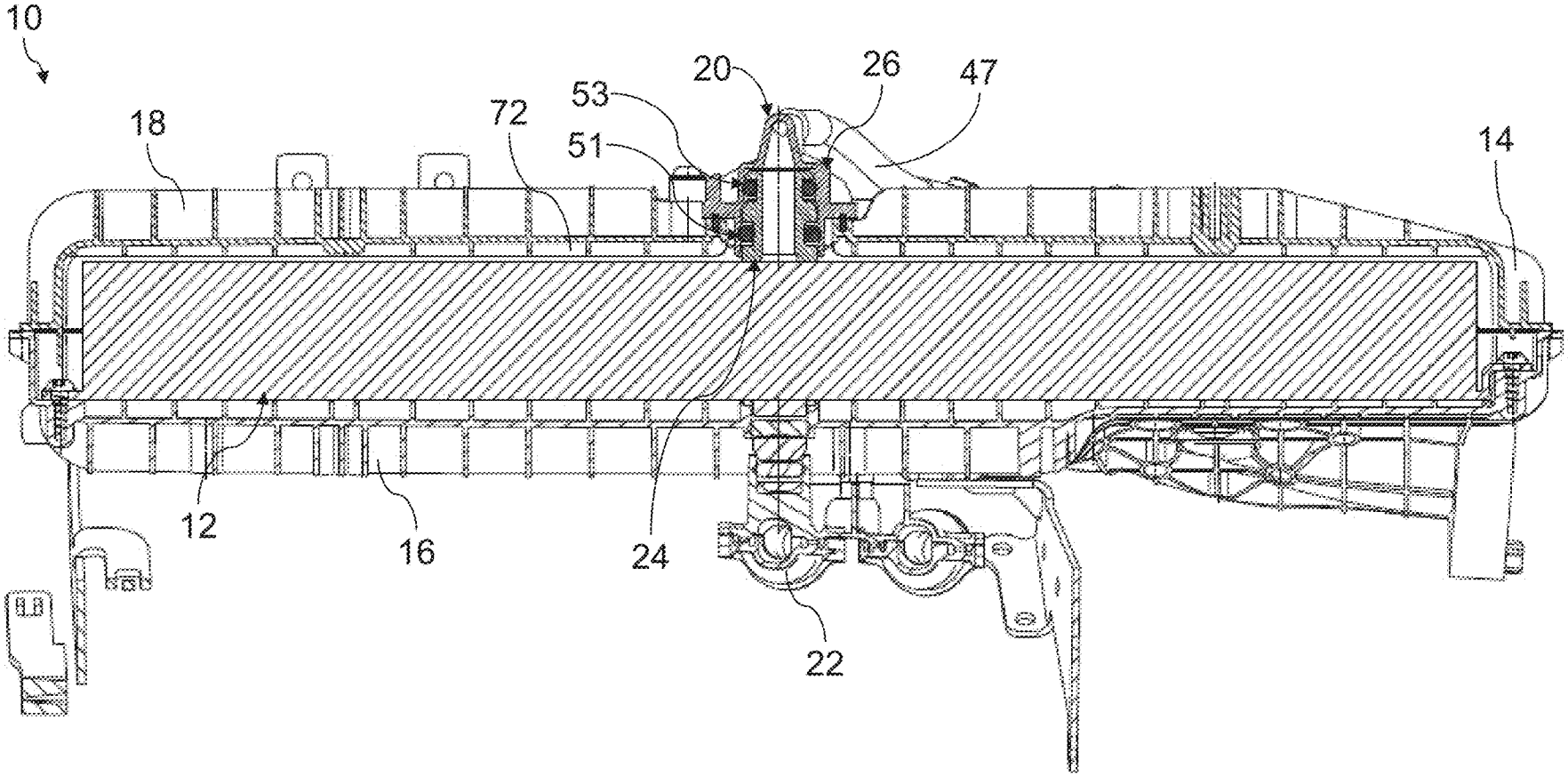
FIG. 2 illustrates a longitudinal section of the intake manifold from FIG. 1 along a cut line II-II.

According to a first exemplary embodiment, the top coolant connection 20 in FIG. 2 according to the invention is arranged in the top shell 18. The top coolant connection 20 can be provided, for example, for discharging the coolant flowing through the charge air cooler 12. Another coolant connection 22—not of further interest here—is the bottom one in FIG. 2 and may be used, for example as supply line for the coolant, is arranged on the bottom shell 16.

Figure 4:
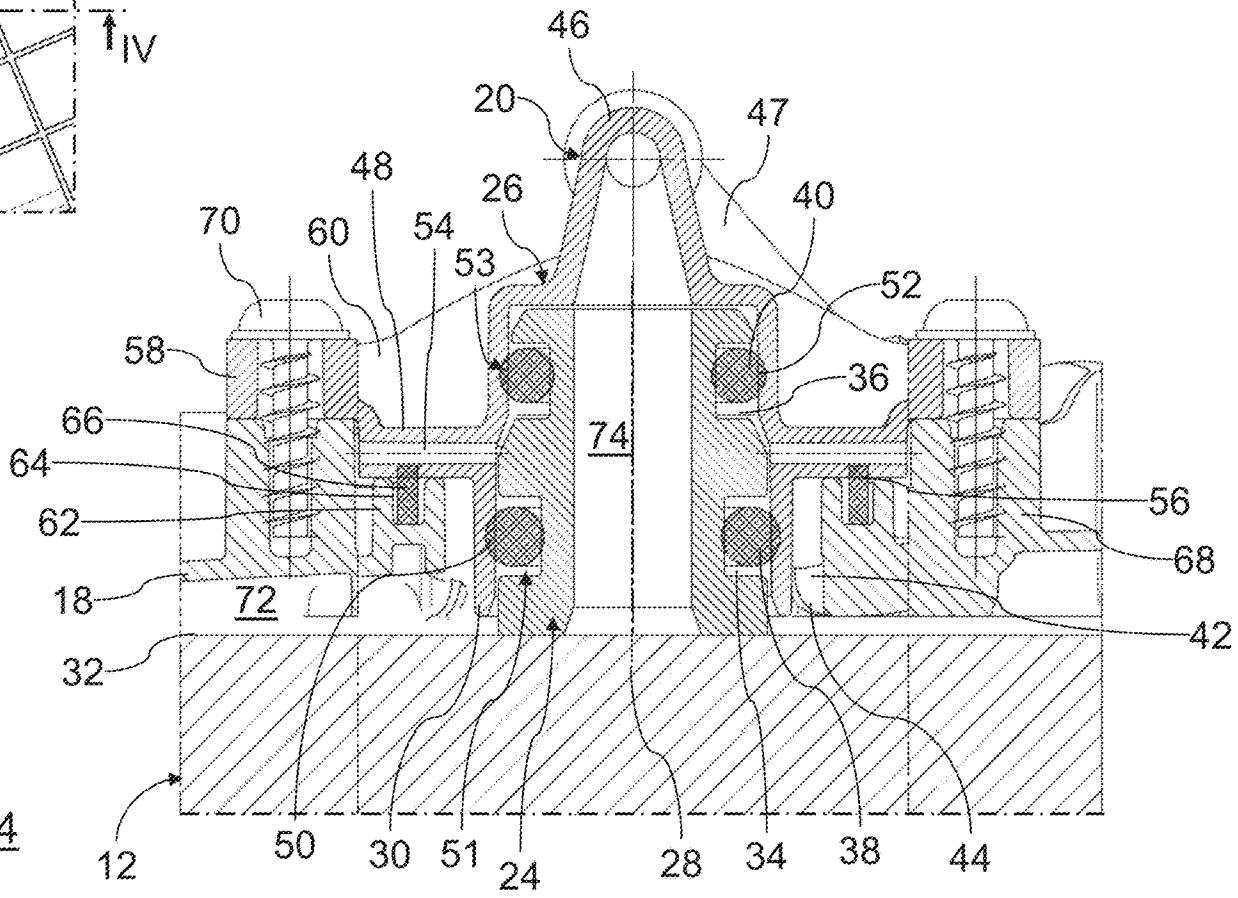
FIG. 4 illustrates a longitudinal section of the detail of the coolant connection from FIG. 3 along the cut line IV-IV shown there.
Figure 3:
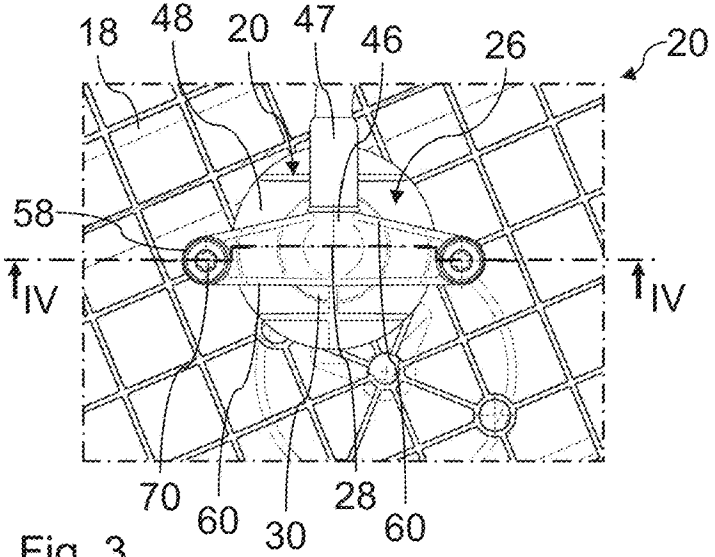
FIG. 3 is a detail view of the plan view of the intake manifold from FIG. 1 in the region of the coolant connection.

The top coolant connection 20 is explained in further detail below in reference to the detail views in FIGS. 3 and 4. The top coolant connection (20) includes a male connector (24) on the side of the charge air cooler (12) and a connection stem (26) on the side of the housing (14). The male connector 24 is inserted coaxially with respect to a connection stem axis 28 into a female connector 30 of the connection stem 26.

Any subsequent discussion of "radial," "axial", "coaxial," "circumferential," or the like is made with respect to the connection stem axis 28, unless otherwise indicated.

The connection stem 24 is made of metal. It is soldered at an end face to a connecting plate 32 of the charge air cooler 12. The connecting plate 32 is also made of metal. The male connector 24 has the shape of a round hollow cylinder. The interior of the hollow cylinder forms a section of a coolant channel for the coolant. The inner space of the male connector 24 is fluidically connected to the coolant channels—not of further interest here—of the charge air cooler 12.

On its radially outer circumferential side, the male connector 24, when viewed axially, has a step roughly tapered toward the center. Its outer diameter on the side toward the connecting plate 32 is greater than on its side away from the connecting plate 32. The course of the graduated step is roughly conical. In the region of its border, which is away from the connecting plate 32, male connector 24 is likewise conically shaped. In this way, the insertion into the female connector 30 is made easier.

On its radially outer circumferential side, the male connector 24 has two coaxial annular grooves 34 and 36. The annular groove toward the connecting plate 32 is designated as inner seal groove 34. The other seal groove is designated as outer seal groove 36. The inner seal groove 34 is located in the cross-sectionally expanded section of the male connector 24, the outer seal groove 36 in the correspondingly tapered section. Arranged in the inner seal groove 34 is an inner sealing ring 38. Arranged in the outer seal groove is an outer sealing ring 40. The sealing rings 38 and 40 each have a sealing effect in the radial direction.

The top shell 18 has a consistently round insertion opening 42. The connection stem 26 and the male connector 24 project from their respective sides through the insertion opening 42. A diameter of the insertion opening 42 is greater than the outer diameter of the female connector 30 and the outer diameter of the male connector 24 there. A circumferential tolerance gap 44 remains between the radially inner edge of the top shell 18 that delimits the insertion opening 42 and the radially outer circumferential side of the connection stem 26.

The by and large single-piece connection stem 26 includes the female connector 30, a connection 46 for a coolant line 47 and a connecting flange 48 for connecting the connection stem 26 to top shell 18. The female connector 30 on its radially inner circumferential side is roughly complementary to the radially outer circumferential side of the male connector 24 and graduated accordingly.

The connecting flange 48 extends circumferentially and in the radial direction away from the female connector 30. The connecting flange 48 is located, when axially viewed, roughly at the height of the graduated step of female connector 30.

In sections that are axially opposite each other with respect to the corresponding graduated step of the female connector 30, the radially inner circumferential side is formed like outer sealing surface 52 for the outer sealing ring 40 and like inner sealing surface 50 for the inner sealing ring 38. In the assembled state, the inner sealing surface 52, the inner sealing ring 38 and the inner seal groove 34 for an inner sealing area 51. The outer sealing surface 52, the outer sealing ring 40 and the outer seal groove 36 form an outer sealing area 53.

A plurality of fluid lines 54 lead out of the connection stem 26 through the wall of female connector 30 between the inner sealing area 50 and the outer sealing area 52, when viewed axially, roughly at the height of the graduated step of the female connector 30. The fluid lines 54 lead through the connecting flange 48 from radially inside to radially outside. The fluid lines 54 are arranged in a circumferentially distributed manner. The fluid lines 54 open radially outward toward the environment.

On the side of the connection 46 for the coolant line 47, an inner contour of an inner space 74 of the male connector 24 transitions there into a corresponding inner contour of an inner space of the connection stem 26.

On its bottom side toward the top shell 18, the connecting flange 48 is provided with a joint sealing surface 56. The joint sealing surface 56 circumferentially surrounds female connector 30 connectedly and coaxially.

Two screw sleeves 58, roughly opposed, are integrally formed on the radially outer circumferential side of the connecting flange 48. The axes of the screw sleeves 58 run parallel to the connection stem axis 28. The screw sleeves 58 are supported by two reinforcement ribs 60. The reinforcement ribs 60 are each integrally joined with the connecting flange 48, the screw sleeves 58 and the female connector 30. The screw sleeves 58 are located, when axially viewed, roughly at the height of the outer sealing surface 52, in FIG. 4 above the connecting flange 48 and the fluid lines 54.

A plane in which the axes of the screw sleeves 58 are located is somewhat offset from the connection stem axis 28. The cut line IV-IV from FIG. 3 has an offset, so that the cut in FIG. 4 runs in the center through the connection stem axis 28 and on the outside on opposite sides through the axes of the screw sleeves 58.

The top shell 18 has a connection collar 62. The connection collar 62 is formed as one piece with the top shell 18. The connection collar 62 can be considered a part of the top coolant connection 20. The connection collar 62 extends coaxially with respect to the insertion opening 42 and circumferentially connectedly surrounds it.

On the outer end face away from the inner space of housing 14, connection collar 62 has a connection seal groove 64. Connection seal groove 64 is open on the side that is axially away from the inner space 72 of the intake manifold 10 with respect to the axis of the insertion opening 42 or the connection stem axis 28.

A joint ring seal 66 is arranged in the connection seal groove 64. The joint ring seal 66 is circumferentially connected. The joint ring seal 66 has, for example, a rectangular profile. In the assembled state of the top coolant connection 20, the joint ring seal 66 abuts in an axially sealing manner with respect to the connection stem axis 28 and the axis of the insertion opening 42 against the joint sealing surface 56 of the connecting flange 48.

Radially outside the connection seal groove 64 are two threaded sleeves 68, each of which is integrally realized on the outer side of the top shell 18. The threaded sleeves 68 are arranged in a distributed manner fitting the screw sleeves 58 of the connection stem 26. The plane through the axes of the threaded sleeves 68 accordingly runs eccentrically with respect to the axis of the insertion opening 42.

The joint sealing surface 56 of the connecting flange 48 clearly projects both radially inside and radially outside the joint ring seal 66. In this way, the connection stem 28 can be assembled in a radially and circumferentially position-tolerant manner with respect to connection stem axis 28 or the axis of the insertion opening 42.

The manufacture of the intake manifold 10 with the charge air cooler 12 is described below. The bottom shell 16, the top shell 18 and the connection stem 26 are each made out of plastic—poured, for example—as separate components. The charge air cooler 12 is prefabricated and soldered to the male connector 24 in such a way that the coolant channels are fluidically connected to the inner space 74 of the male connector 24. Accordingly, means—not of further interest here—for the connection to the bottom coolant connection 22 of the bottom shell 16 on the charge air cooler 12.

The inner sealing ring 38 is arranged in the inner seal groove 34 and the outer sealing ring 40 in the outer seal groove 36 of the male connector 24.

The charge air cooler 12 is inserted in the bottom shell 16 bottom side first (in FIG. 2 from the top) in such a way that the corresponding joining means correspond to the bottom coolant connection 22 of to bottom shell 16.

Then the top shell 18 is placed onto the bottom shell 16 from above in such a way that the male connector 24 projects through the insertion opening 42. The top shell 18 and the bottom shell 16 are welded along their borders with each other. Thanks to the tolerance gap 44 in conjunction with the joint ring seal 66, which is position-tolerant in the radial direction, and the joint sealing surface 56, the bottom shell 16 and the top shell 18 can be connected to each other with a greater position tolerance. The connection stem axis 28 and the axis of the insertion opening 42 may coincide. Because of the corresponding positional tolerance, the axes can also be set offset to one another.

The joint ring seal 66 is inserted in the connection seal groove 64. The connection stem 26 is placed on the male connector 24 with the female connector 30 first. It may be necessary to turn the connection stem 26 around the connection stem axis 28 in such a way that the screw sleeves 58 are aligned with the respective threaded sleeves 68.

Finally, screws 70 are inserted through the threaded holes of the screw sleeves 58 and into the internal threads of the threaded sleeves 68. In this context, the connection stem 26 is pressed in the axial direction, with respect to connection stem axis 28 and the axis of the insertion opening 42, against the bottom shell 16.

The joint ring seal 66 axially abuts in a sealing manner against joint sealing surface 56. The joint ring seal 66 seals the inner space 72 of the intake manifold 10, which discharges the charge air out to the environment.

The inner sealing ring 38 abuts in a radially sealing manner against the inner sealing surface 50. The inner sealing ring 38 seals the inner space 72 off from the fluid lines 54.

The outer sealing ring 40 abuts in a radially sealing manner against the outer sealing surface 52. The outer sealing ring 40 seals the inner space 74 of the male connector 24 and the coolant channel in the connection 46 off from the fluid lines 54.

The outer sealing ring 40 and the inner sealing ring 38 prevent the coolant from getting out of the coolant-conducting inner space 74 and the coolant line 47 into the inner space 72 of the intake manifold 10 and can mix there with the charge air. In this way coolant can be prevented from getting into combustion chambers of the internal combustion engine.

If there is a leak in the outer sealing area 53, the coolant can get from the coolant-conducting inner space 74 and the coolant line 47 into the fluid lines 54. The coolant can flow from there out into the environment. This can be detected from outside. In this way, a leak in the outer sealing area 53 can be detected from outside the top coolant connection 20. Furthermore, due to the discharge of the coolant through the fluid lines 54, the coolant can be prevented in the event of a leak there on the inner sealing ring 38 from getting into the inner space 72 of the intake manifold 10. A corresponding pressure of the coolant can be diminished via the fluid lines 54.

Figure 5:
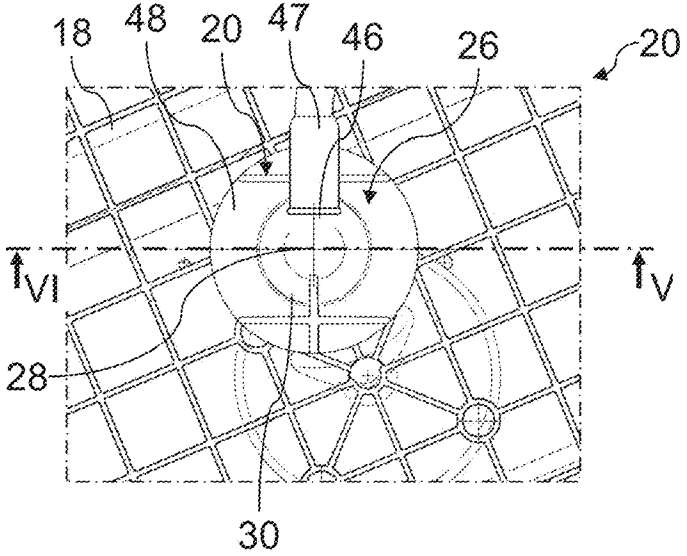
FIG. 5 a detail view of a coolant connection according to a second embodiment that is similar to the coolant connection according to the first embodiment from FIGS. 1 to 4.
Figure 6:
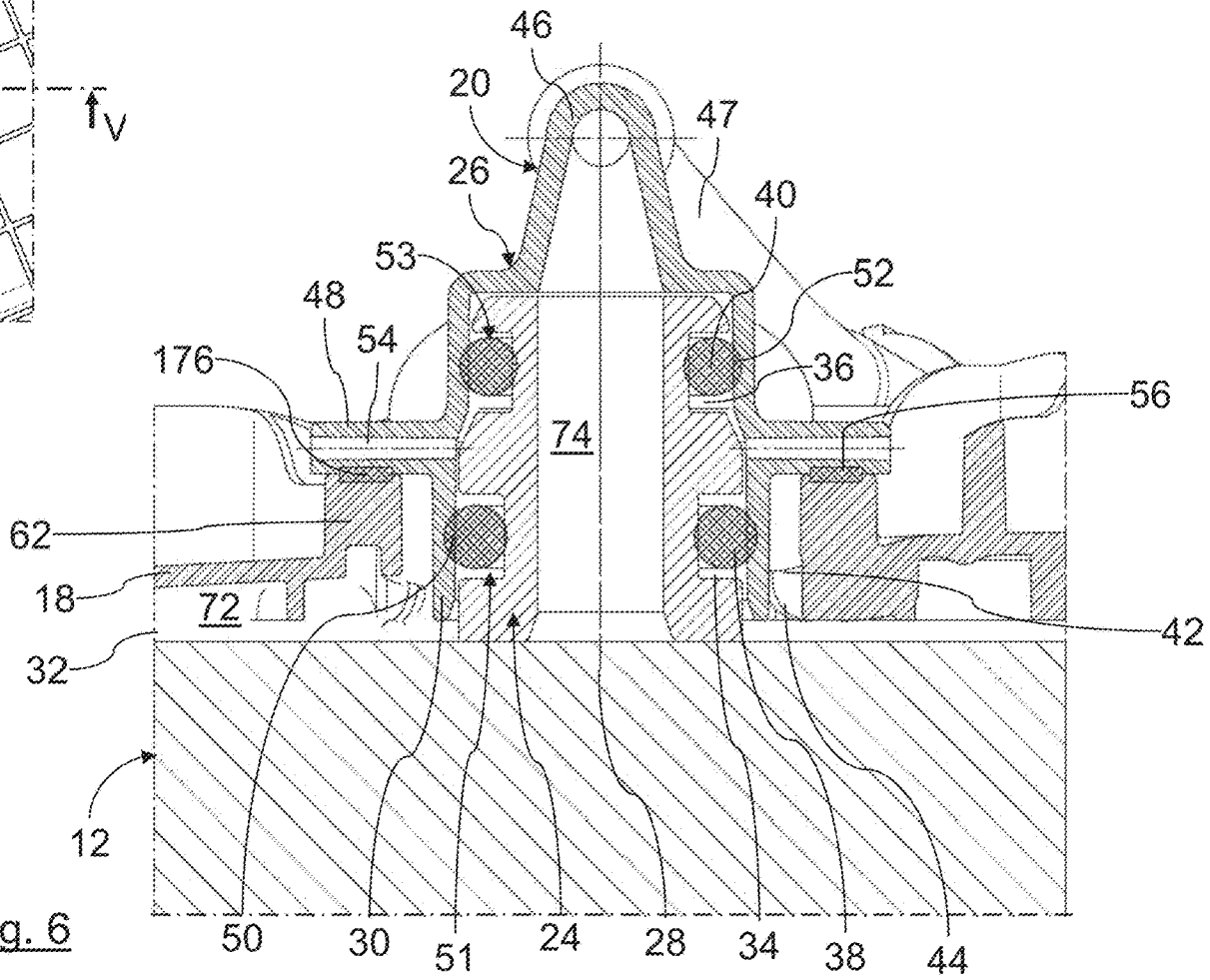
FIG. 6 is a longitudinal section of the coolant connection from FIG. 5 along the cut line VI-VI shown there.

A second exemplary embodiment of a top coolant connection 20 is shown in FIGS. 5 and 6. Those elements that are similar to those of the first embodiment from FIGS. 1 to 4 are provided with the same reference signs. The second exemplary embodiment differs from the first exemplary embodiment in that the connection stem 26 is connected to the top shell 18 not via a threaded joint but via a welded joint. The connection seal groove 64, the joint ring seal 66, the connection collar 62, the threaded sleeves 68, the screw sleeves 58 and the screws 70 can be omitted.

The joint sealing surface 56 is provided in the second exemplary embodiment as a joint welding surface 156. The axially outer end face of the connection collar 62 of the top shell 18 is likewise configured as a joint welding surface. The joint welding surface 156 of the connecting flange 48 is welded in a radially and circumferentially—with respect to connection stem axis 28 and the axis of the insertion opening 52—positionally tolerant way to the edge of the connection collar 62 along an annular welding seam 176. The welding 176 is circumferentially connected and in this way forms a circumferential sealing device between the inner space 72 of intake manifold 10 and the environment.

The connection stem axis 28 and the axis of the insertion opening 42 may also coincide in the second exemplary embodiment. Because of the corresponding positional tolerance, the axes can also be set offset to one another.

What is claimed is:

1. A coolant connection of a heat exchanger arranged within a housing, comprising:

a male connector arranged on and projecting outwardly from a side of the heat exchanger, wherein the heat exchanger is arranged in an interior of the housing, the male connector projecting through an opening in the outer wall of the housing to an exterior of the housing;

a connection stem arranged on a side of the housing, the connection stem including a first end of the connection stem arranged at or facing towards the heat exchanger, the first end forming a female connector adapted for mating to and connection to the male connector, the first end having:

a radially projecting connecting flange formed on a radial outer surface of the female connector; the radially projecting connecting flange surrounding the radial outer surface of the female connector, radially projecting connecting flange having:

at least one mounting opening formed at an outer circumference of the radially projecting connecting flange and extending through the radially projecting connecting flange;

at least one fluid line arranged in an interior of the radially projecting connecting flange, the at least one radially extending fluid line having a first fluid line end which opens into an inner space of the female connector, and having a second fluid line end which opens through the outer circumference of the radially projecting connecting flange to an outside environment; and a second end of the connection stem arranged fluidically outwardly away from the heat exchanger and the first end of the connection stem, the second end of the connection stem adapted for connecting to a coolant line or adapted to form a part of the coolant line;

at least two seals arranged between the male connector and the female connector, which when in an assembled state in which the male connector at least partially projects into an interior of the female connector, the at least two seals and sealing areas are arranged to running circumferentially with respect to a connection stem axis around a circumference of the male connector;

wherein one of the at least two seals is an inner seal forming an inner sealing area arranged inwardly relative to the heat exchanger;

wherein one of the at least two seals is an outer seal forming an outer sealing area arranged outwardly from the inner sealing area;

wherein the second fluid line end of the at least one radially extending fluid line opens into the inner space of the of the female connector between the inner seal and the outer seal;

wherein the outer sealing area seals against a coolant-conducting area extending through the connection stem;

wherein the inner sealing area seals against a fluid-conducting area for fluid to be cooled by the heat exchanger;

wherein between the outer sealing area and the inner sealing area, the at least one fluid line leads from the inner space of the female connector through a circumferential wall of the connection stem, continuing radially outwardly through an interior of the radially projecting connecting flange of the female connector to outer circumference of the radially projecting connecting flange where the at least one fluid line opens to the outside environment.

2. The coolant connection according to claim 1, wherein the connection stem is connected by multiple parts to at least one housing section of the housing; and/or the connection stem is connected by the radially projecting connecting flange to at least one housing section of the housing.

3. The coolant connection according to claim 1, wherein the connection stem is connected to at least one housing section of the housing by a connection selected from the set consisting of:

a form-fitting connection; and/or non-positive connection.

4. The coolant connection according to claim 1, further comprising:

at least one connection device arranged on the connecting stem and connecting to at least one housing section of the housing, the at least one connection device arranged between the fluid-conducting area of the housing for fluid to be cooled and an open environment outside of the housing.

5. The coolant connection according to claim 1, further comprising:

at least one sealing device arranged between and sealing between the connection stem and at least one housing section of the housing.

6. The coolant connection according to claim 1, wherein: the inner seal and/or the outer seal act radially with respect to the connection stem axis.

7. The coolant connection according to claim 1, wherein: the male connector and the connection stem are made of different materials such that the male connector and the connection stem are not integrally joinable together.

8. A connection stem of a coolant connection of a heat exchanger arranged within a housing, comprising:

a first end of the connection stem arranged at or facing towards the heat exchanger, the first end forming a female connector adapted for mating to and connection to a male connector, the first end having:

a radially projecting connecting flange formed on a radial outer surface of the female connector; the radially projecting connecting flange surrounding the radial outer surface of the female connector, radially projecting connecting flange having:

at least one mounting opening formed at an outer circumference of the radially projecting connecting flange and extending through the radially projecting connecting flange;

at least one fluid line arranged in an interior of the radially projecting connecting flange, the at least one radially extending fluid line having a first fluid line end which opens into an inner space of the female connector, and having a second fluid line end which opens through the outer circumference of the radially projecting connecting flange to an outside environment; and a second end of the connection stem arranged fluidically outwardly away from the heat exchanger and the first end of the connection stem, the second end of the connection stem adapted for connecting to a coolant line or adapted to form a part of the coolant line;

at least two seals arranged between the male connector and the female connector, which when in an assembled state in which the male connector at least partially projects into an interior of the female connector, the at least two seals and sealing areas are arranged to running circumferentially with respect to a connection stem axis around a circumference of the male connector;

wherein one of the at least two seals is an inner seal forming an inner sealing area arranged inwardly relative to the heat exchanger;

wherein one of the at least two seals is an outer seal forming an outer sealing area arranged outwardly from the inner sealing area;

wherein the second fluid line end of the at least one radially extending fluid line opens into the inner space of the of the female connector between the inner seal and the outer seal;

wherein the outer sealing area seals against a coolant-conducting area extending through the connection stem;

wherein the inner sealing area is adapted to seal against a fluid-conducting area for fluid to be cooled by the heat exchanger;

wherein between the outer sealing area and the inner sealing area, the at least one fluid line leads from the inner space of the female connector through a circumferential wall of the connection stem, continuing radially outwardly through an interior of the radially projecting connecting flange of the female connector to outer circumference of the radially projecting connecting flange where the at least one fluid line opens to the outside environment.

* * * * *